US005338244A

United States Patent [19]

Huang

[11] Patent Number: 5,338,244

[45] Date of Patent: Aug. 16, 1994

[54] HOOP TOY

[75] Inventor: Thomas N. Huang, Taoyuan, Taiwan

[73] Assignee: Full-Zone Corporation, Taoyuan, Taiwan

[21] Appl. No.: 76,992

[22] Filed: Jun. 15, 1993

[51] Int. Cl.[5] ..... A63H 33/02

[52] U.S. Cl. ..... 446/242; 446/236; 446/411

[58] Field of Search ..... 446/28, 242, 236, 81, 446/120, 450, 411, 412

[56] References Cited

U.S. PATENT DOCUMENTS

| | | | |
|---|---|---|---|
| 2,063,895 | 12/1936 | Mack | 446/120 |
| 3,904,193 | 9/1975 | Canonge | 482/81 |
| 4,215,510 | 8/1980 | Worrell | 446/28 |
| 4,380,885 | 4/1983 | Komagata | 446/236 |
| 5,108,340 | 4/1992 | Farrow | 446/242 |

FOREIGN PATENT DOCUMENTS

| | | | |
|---|---|---|---|
| WO90/13337 | 11/1990 | World Int. Prop. O. | 446/236 |

*Primary Examiner*—Mickey Yu
*Attorney, Agent, or Firm*—Ladas & Parry

[57] ABSTRACT

A hoop toy includes a plurality of arcuate tubular members. Each of the arcuate tubular members has a first end and a second end opposite to the first end. The first end of one of the arcuate tubular members is connected to the second end of an adjacent one of the arcuate tubular members so as to form a hoop. The hoop toy further has an elastic cord which passes through the arcuate tubular members in order to tie the latter together.

4 Claims, 5 Drawing Sheets

HOOP TOY

BACKGROUND OF THE INVENTION

1. Field of the Invention

This invention relates to a hoop toy, more particularly to an improved detachable hoop toy.

2. Description of Related Art

It has been known that a hoop toy can be composed of a plurality of separated arcuate elongated portions. Those arcuate elongated portions can be connected to one another to form a hoop. A main drawback of the hoop toy is that the arcuate elongated portions which are connected together to form the hoop easily become detached from one another when playing with the hula hoop. At his time, the separated arcuate elongated portions are scattered and fall here and there.

SUMMARY OF THE INVENTION

Therefore, the objective of this invention is to provide an improved detachable hoop toy that includes a plurality of arcuate tubular members which can be connected firmly to one another so as to prevent the untimely detachment.

Accordingly, a hoop toy of this invention includes a plurality of arcuate tubular members. Each of the arcuate tubular members has a first end and a second end opposite to the first end. The first end of one of the arcuate tubular members is connected to the second end of an adjacent arcuate tubular member so as to form a hoop. The hula hoop further has an elastic cord which passes through the arcuate tubular members in order to tie the latter together.

The first end of the arcuate tubular members has a constricted insert portion extending longitudinally therefrom. The constricted insert portion has a tubular wall which is formed with a longitudinally split resilient plate portion that has a protrusion projecting radially therefrom. The tubular wall further has a chord-like member which extends across the tubular wall adjacent to the longitudinally split resilient plate in order to prevent the elastic cord from being entangled with the longitudinally split resilient plate portion. The second end of each of the arcuate tubular members is formed with a hole. When the constricted insert portion on the first end of one of the arcuate tubular members is inserted into the second end of an adjacent one of the arcuate tubular members, the protrusion on the longitudinally split resilient plate portion engages in the hole of the second end.

The hoop toy may further have a ball which is provided movably in the arcuate tubular members when the latter forms the hoop.

BRIEF DESCRIPTION OF THE DRAWINGS

Other features and advantages of the present invention will become apparent in the following detailed description of the preferred embodiment, with reference to the accompanying drawings, in which.

DETAILED DESCRIPTION OF THE PREFERRED EMBODIMENT

Figure 1:
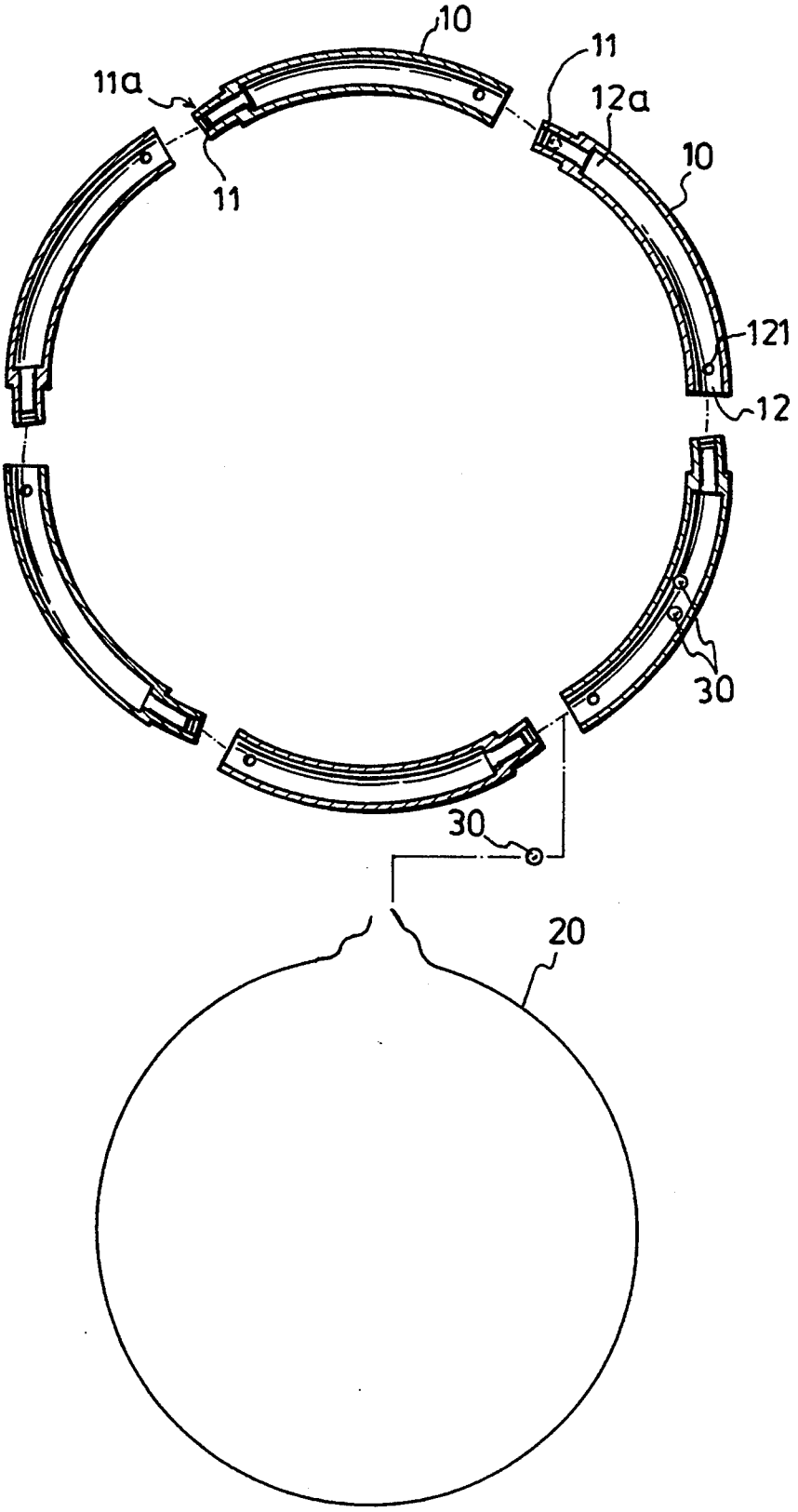
FIG. 1 is an exploded view of a hoop toy of this invention.
Figure 2:
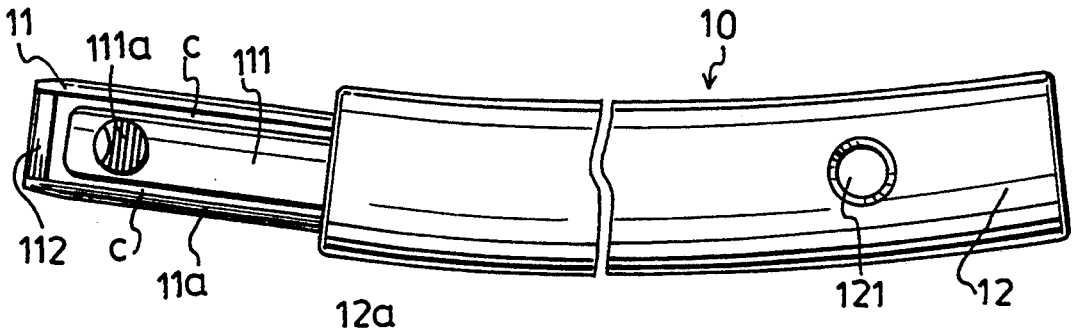
FIG. 2 is a perspective view of one of the arcuate tubular members of this invention.
Figure 2A:
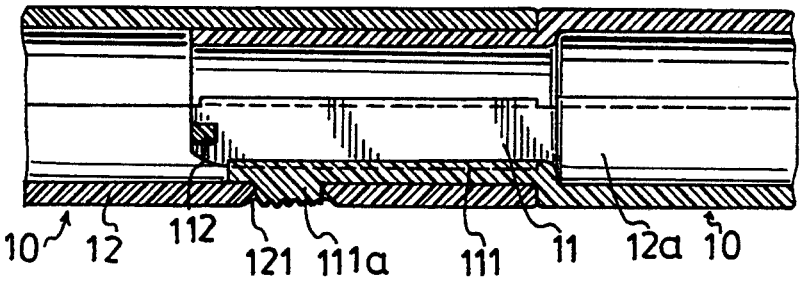
FIG. 2A is a sectional view showing connection between a first end of one of the arcuate tubular members and a second end of an adjacent arcuate tubular member.
Figure 3:
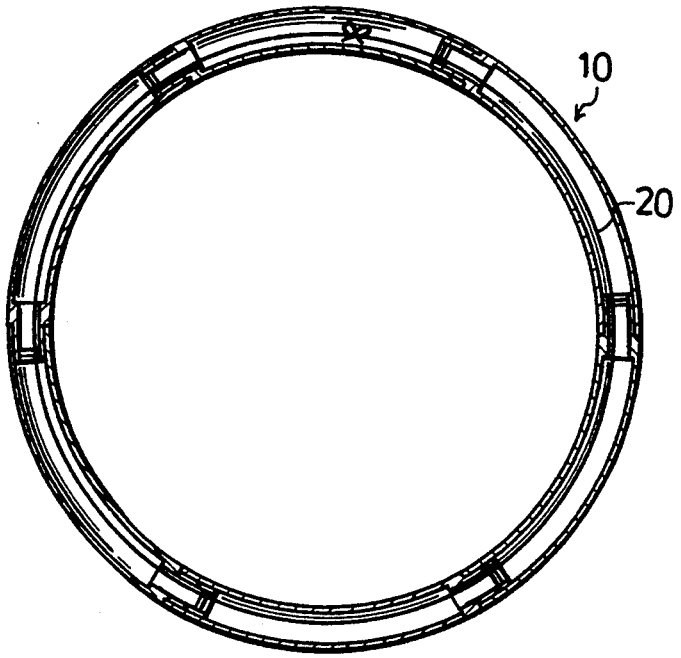
FIG. 3 is an assembled view of this invention.
Figure 4:
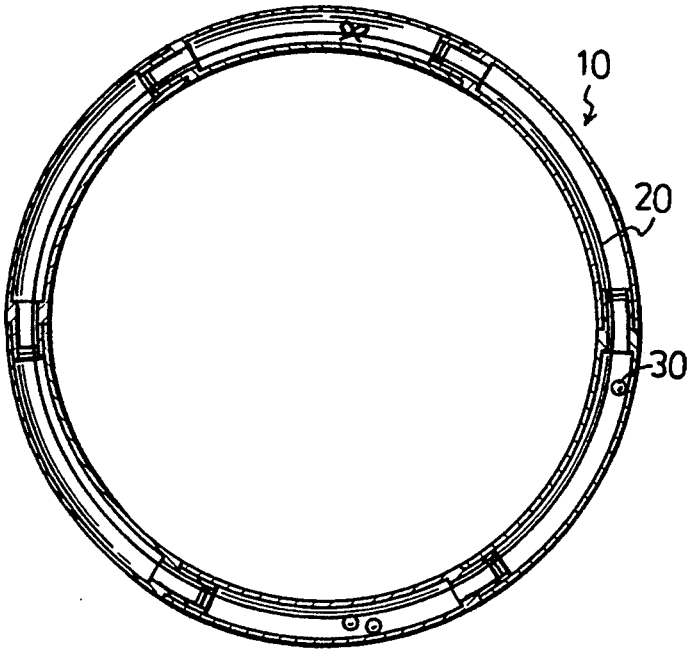
FIG. 4 is an assembled view of this invention in which a ball is provided.

FIGS. 1 to 4 show a preferred embodiment of a hoop toy of this invention. The hula hoop has five arcuate tubular members (10) each of which has a first end (12*a*) and a second end (12). The first end (12*a*) has a constricted insert portion (11*a*) extending longitudinally therefrom. The constricted insert portion (11*a*) has a tubular wall (11) which is formed with a longitudinally split resilient plate portion (111). Two clearances (c) reside between the tubular wall (11) and the resilient plate portion (111). The resilient plate portion (111) has a protrusion (111*a*) projecting radially therefrom. The tubular wall (11) further has a chord-like member (112) which extends across the tubular wall (11) adjacent to the resilient plate portion (111). The second end (12) is formed with a hole (121). The protrusion (111*a*) on one of the arcuate tubular members (10) engages in the hole (121) of an adjacent arcuate tubular member (10) when the constricted insert portion (11*a*) of said one of the arcuate tubular members (10) is received in the second end (12) of the adjacent arcuate tubular member (10). The hoop toy further has an elastic cord (20). When assembling the hoop toy, the elastic cord (20) passes primarily through each of the arcuate tubular members (10). The arcuate tubular members (10) are connected to one another except that the first end (12*a*) of the fifth arcuate tubular member (10) is still separated from the second end of the sixth arcuate tubular member (10). Afterwards, the arcuate tubular members (10) are closely tied with the elastic cord (20). Finally, the constricted insert portion (11*a*) on the fifth arcuate tubular member (10) is inserted into the second end (12) of the sixth arcuate tubular member (10) so that a hoop is formed. Due to the provision of the chord-like members (112), the elastic cord (20) does not engage the clearances (c) and is not entangled with the resilient plate portions (111). By means of the engagement between each protrusion (111*a*) and each hole (121), the arcuate tubular members (10) can be connected firmly to one another. In addition, the provision of the elastic cord (20) enhances engagement between the arcuate tubular members (10). In such a way, the arcuate tubular members (10) cannot detach easily from one another when rotating the hoop toy so that the playing of the hoop toy can be ensured. When the hoop toy is not used, the arcuate tubular members (10) are detached from one another and are bound together with the elastic cord (20) to facilitate storage and carrying.

The hoop toy can further have balls (30) which are provided movably in the arcuate tubular members (10). Referring again to FIG. 4, the balls (30) roll in the arcuate tubular members (30) to provide a sound when rotating the hoop toy so as to provide amusement.

Figure 5:
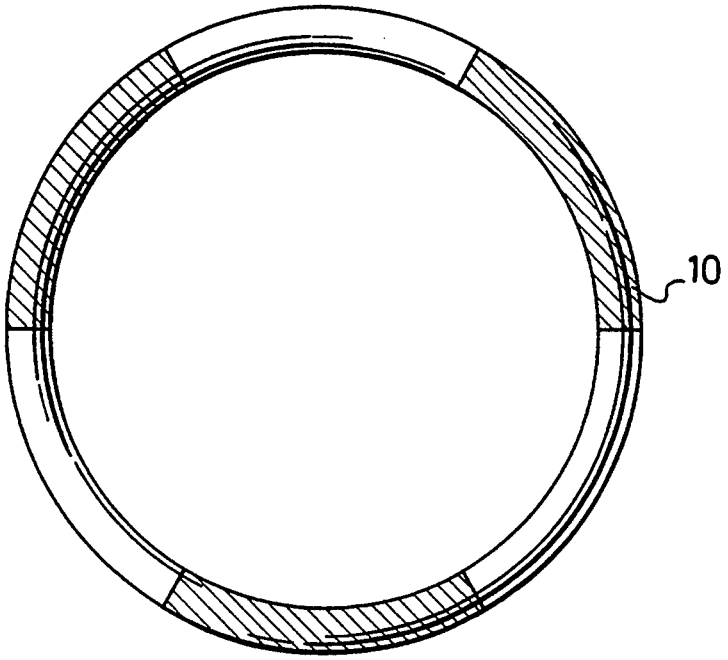
FIG. 5 is a schematic view of this invention showing the appearance thereof.

Referring to FIG. 5, the outer surface of one of the arcuate tubular members (10) has a color different from that of an adjacent one of the arcuate tubular members (10) in order to enhance the appearance of the hoop toy.

In addition, the outer surface of each of the arcuate tubular members (10) may have a different collar.

Figure 6:
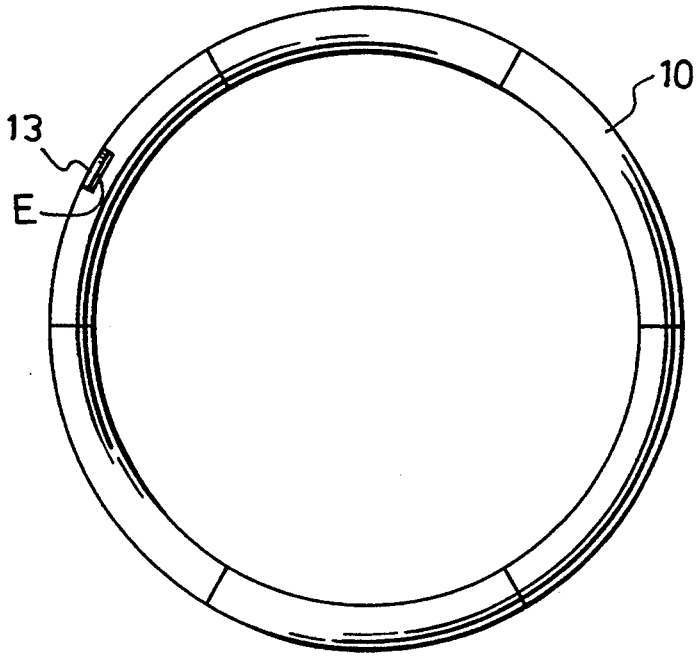
FIG. 6 is a schematic view of this invention showing a recess formed thereon.

Referring to FIG. 6, one of the arcuate tubular members (10) has an outer surface formed with a recess (13). The hoop toy further has an electrical unit (E) which is received in the recess (13) for providing light and music when rotating the hula hoop so as to provide amusement.

Figure 7:
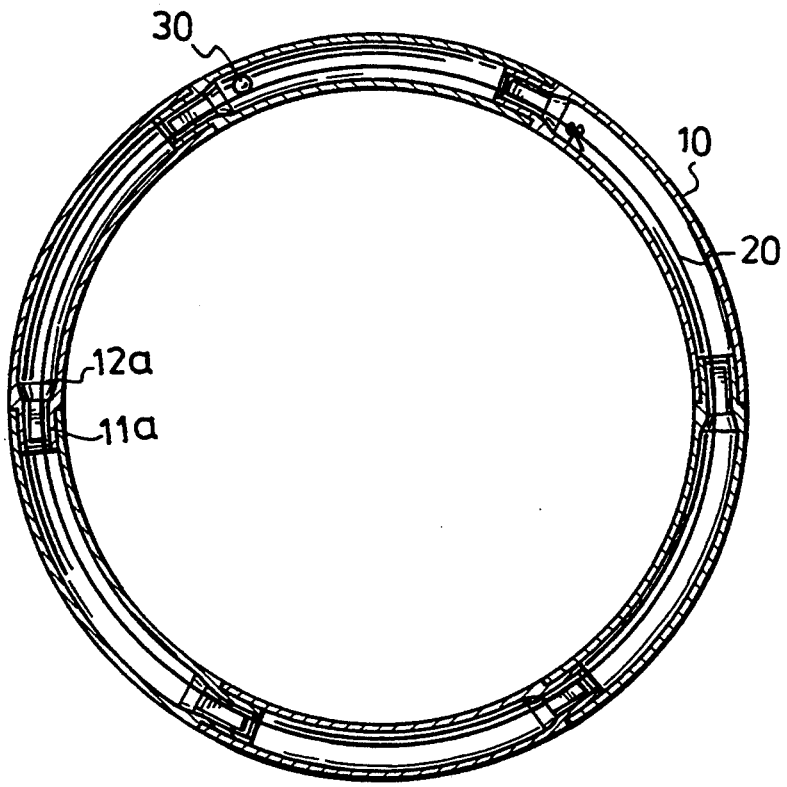
FIG. 7 is a sectional view of this invention showing the smoothly inclined inner surface thereof.

Referring to FIG. 7, the inner surface of each of the arcuate tubular members (10) may be inclined smoothly from the first end (12*a*) toward the constricted insert portion (11*a*) in order to facilitate movement of the ball (30).

Furthermore, each arcuate tubular member (10) can be composed of two longitudinally elongated halves. Both the longitudinal elongated halves are manufactured respectively and are adhered together to form the arcuate tubular member (10).

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A hoop toy comprising a plurality of arcuate tubular members, each of said arcuate tubular members having a first end and a second end opposite to said first end, said first end of one of said arcuate tubular members being connected to said second end of an adjacent one of said arcuate tubular members so as to form a hoop; and an elastic cord passing through said arcuate tubular members in order to tie the latter together wherein each of said first end of said arcuate tubular members has a constricted insert portion extending longitudinally therefrom, said constricted insert portion having a tubular wall which is formed with a longitudinally split resilient plate portion that has a protrusion projecting radially therefrom, said tubular wall further having a chord-like member which extends across said tubular wall adjacent to said longitudinally split resilient plate in order to prevent said elastic cord from being entangled with said longitudinally split resilient plate portion, said second end of each of said arcuate tubular members being formed with a hole, when said constricted insert portion on said first end of one of said arcuate tubular members is inserted into said second end of an adjacent one of said arcuate tubular members, said protrusion on said longitudinally split resilient plate portion engaging said hole on said second end.

2. A hoop toy as claimed in claim 1, further comprising a ball which can be provided movably in said arcuate tubular members when the latter forms said hoop.

3. A hoop toy as claimed in claim 1, wherein one of said tubular members has a color different from that of an adjacent one of said tubular members.

4. A hoop toy as claimed in claim 1, wherein one of said arcuate tubular members has a tubular outer surface formed with a recess, said hoop toy further having an electrical unit which is received in said recess for providing light and music when rotating said hula hoop.

* * * * *